US009498783B2

(12) United States Patent
Ackley et al.

(10) Patent No.: US 9,498,783 B2
(45) Date of Patent: Nov. 22, 2016

(54) PASSIVELY ENERGIZED FIELD WIRE FOR ELECTRICALLY ENHANCED AIR FILTRATION SYSTEM

(75) Inventors: Alan Ackley, Louisville, CO (US); Maurice L. Frappier, Louisville, CO (US); Ronald L. Bowman, Louisville, CO (US)

(73) Assignee: CARRIER CORPORATION, Farmington, CT (US)

( * ) Notice: Subject to any disclaimer, the term of this patent is extended or adjusted under 35 U.S.C. 154(b) by 150 days.

(21) Appl. No.: 14/118,373

(22) PCT Filed: May 14, 2012

(86) PCT No.: PCT/US2012/037763
§ 371 (c)(1),
(2), (4) Date: Nov. 18, 2013

(87) PCT Pub. No.: WO2012/162005
PCT Pub. Date: Nov. 29, 2012

(65) Prior Publication Data

US 2014/0096680 A1 Apr. 10, 2014

Related U.S. Application Data

(60) Provisional application No. 61/489,543, filed on May 24, 2011.

(51) Int. Cl.
*B03C 3/02* (2006.01)
*B03C 3/155* (2006.01)
(Continued)

(52) U.S. Cl.
CPC ..... *B03C 3/025* (2013.01); *B03C 3/09* (2013.01); *B03C 3/12* (2013.01); *B03C 3/155* (2013.01);
(Continued)

(58) Field of Classification Search
CPC combination set(s) only.
See application file for complete search history.

(56) References Cited

U.S. PATENT DOCUMENTS 2,502,560 A * 4/1950 Dahlman ..... B03C 3/155 55/483
2,990,912 A * 7/1961 Cole ..... B03C 3/12 96/68
(Continued)

FOREIGN PATENT DOCUMENTS

GB 464192 A 4/1937

OTHER PUBLICATIONS

Notification of Transmittal of the International Report on Patentability of the International Searching Authority, or the Declaration; PCT/US2012/037763; Nov. 26, 2013, 8 Pages.
(Continued)

*Primary Examiner* — Duane Smith
*Assistant Examiner* — Sonji Turner
(74) *Attorney, Agent, or Firm* — Cantor Colburn LLP

(57) ABSTRACT

An air filtration system includes a frame directing an airflow through the air filtration system and a power supply. An ionization array is located in the frame across the airflow and connected to the power supply. The power supply provides a first voltage to the ionization array. A field wire is located in the frame downstream from the ionization array and is energized to a second voltage only by an electrical energy discharge from the ionization array. A method of operating an electrically enhanced air filtration system includes energizing an ionization array, located across an airflow through the air filtration system, to a first voltage via electrical power supplied by a power supply. Electrical energy is discharged from the ionization array into the airflow. A field wire downstream of the ionization array is energized to a second voltage only by the discharge of electrical energy from the ionization array.

3 Claims, 2 Drawing Sheets

(51) Int. Cl.

| | |
|---|---|
| ***B03C 3/09*** | (2006.01) |
| ***B03C 3/12*** | (2006.01) |
| ***B03C 3/41*** | (2006.01) |
| ***B03C 3/47*** | (2006.01) |
| ***B03C 3/68*** | (2006.01) |

(52) U.S. Cl.
CPC . *B03C 3/41* (2013.01); *B03C 3/47* (2013.01); *B03C 3/68* (2013.01); *B03C 2201/04* (2013.01); *B03C 2201/10* (2013.01)

(56) References Cited

U.S. PATENT DOCUMENTS 3,271,932 A * 9/1966 Newell ..... B03C 3/155 55/491
3,438,180 A * 4/1969 Klouda ..... B03C 3/14 439/894
3,626,668 A * 12/1971 Cardiff ..... B03C 3/155 55/282
4,781,736 A * 11/1988 Cheney ..... B03C 3/155 96/60
4,853,005 A * 8/1989 Jaisinghani ..... B03C 3/38 96/60
4,878,149 A * 10/1989 Stiehl ..... H05F 3/04 361/230
4,940,470 A * 7/1990 Jaisinghani ..... B03C 3/38 55/521
5,330,559 A * 7/1994 Cheney ..... B03C 3/155 95/63
5,403,383 A * 4/1995 Jaisinghani ..... B03C 3/66 422/22
5,549,735 A 8/1996 Coppom
5,846,302 A * 12/1998 Putro ..... B03C 3/66 96/66
5,944,860 A 8/1999 Mack et al.
6,251,171 B1 * 6/2001 Marra ..... B03C 3/12 96/69
7,067,939 B2 * 6/2006 Hartmann ..... B03C 3/68 307/108
7,156,898 B2 * 1/2007 Jaisinghani ..... B03C 3/09 264/257
7,160,363 B2 * 1/2007 Kulmala ..... B03C 3/155 96/67
7,212,393 B2 * 5/2007 Gefter ..... H01T 23/00 361/230
7,351,274 B2 4/2008 Helt et al.
7,594,958 B2 * 9/2009 Krichtafovitch ..... B03C 3/68 315/506
7,815,719 B2 * 10/2010 McKinney ..... B03C 3/09 323/903
7,815,720 B2 * 10/2010 McKinney ..... B03C 3/09 96/63
8,080,094 B2 * 12/2011 Vanderginst ..... B03C 3/09 96/66
9,034,068 B2 5/2015 Ball et al.
2002/0152890 A1 10/2002 Leiser
2003/0071521 A1 * 4/2003 Hartmann ..... B03C 3/68 307/108
2004/0004797 A1 * 1/2004 Krichtafovitch ..... B03C 3/68 361/91.1
2004/0074387 A1 4/2004 Jaisinghani
2006/0150816 A1 7/2006 Jaisinghani
2006/0180023 A1 * 8/2006 Coppom ..... B03C 3/09 95/59
2006/0236667 A1 10/2006 Terlson
2008/0156186 A1 * 7/2008 McKinney ..... B03C 3/09 95/2
2009/0025402 A1 * 1/2009 Mello ..... B03C 3/09 62/78
2009/0183474 A1 7/2009 Workman
2009/0183477 A1 7/2009 Workman
2009/0183636 A1 7/2009 Levine
2010/0251895 A1 * 10/2010 VanDerGinst ..... B03C 3/09 96/83
2011/0006216 A1 * 1/2011 Searle ..... A61L 9/16 250/455.11
2011/0219954 A1 * 9/2011 McKinney ..... B01D 46/0032 96/55

OTHER PUBLICATIONS

Notification of Transmittal of the International Search Report and the Written Opinion of the International Searching Authority, or the Declaration; PCT/US2012/037763; Sep. 28, 2012; 12 pages.

* cited by examiner

PASSIVELY ENERGIZED FIELD WIRE FOR ELECTRICALLY ENHANCED AIR FILTRATION SYSTEM

BACKGROUND OF THE INVENTION

The subject matter disclosed herein relates to air filtration systems. More specifically, the subject disclose relates to field wires for electrically enhanced air filtration systems.

In air filtration systems, for example, electrically enhanced air filtration systems, electrostatic filters installed in the systems collect impurities in an airflow through the system before the airflow is circulated through a space such as a home or other building. The systems utilize an electrically-charged ionization array and an electrically-charged field wire located across the airflow upstream of the electrostatic filter. These components are intended to increase the effectiveness of collection of the impurities by the media filter.

Typically, the field wire is energized to first voltage by the power supply and the ionization array is energized to a second voltage by the power supply. Thus the power supply must produce two voltages, which are also regulated by the power supply.

BRIEF DESCRIPTION OF THE INVENTION

According to one aspect of the invention, an air filtration system includes a frame directing an airflow through the air filtration system and a power supply. An ionization array is located in the frame across the airflow and connected to the power supply. The power supply provides a first voltage to the ionization array. A field wire is located in the frame downstream from the ionization array and is energized to a second voltage only by an electrical energy discharge from the ionization array.

According to another aspect of the invention, a method of operating an electrically enhanced air filtration system includes energizing an ionization array to a first voltage via electrical power supplied by a power supply. The ionization array is located across an airflow through the air filtration system. Electrical energy is discharged from the ionization array into the airflow. A field wire located downstream of the ionization array is energized to a second voltage only by the discharge of electrical energy from the ionization array.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
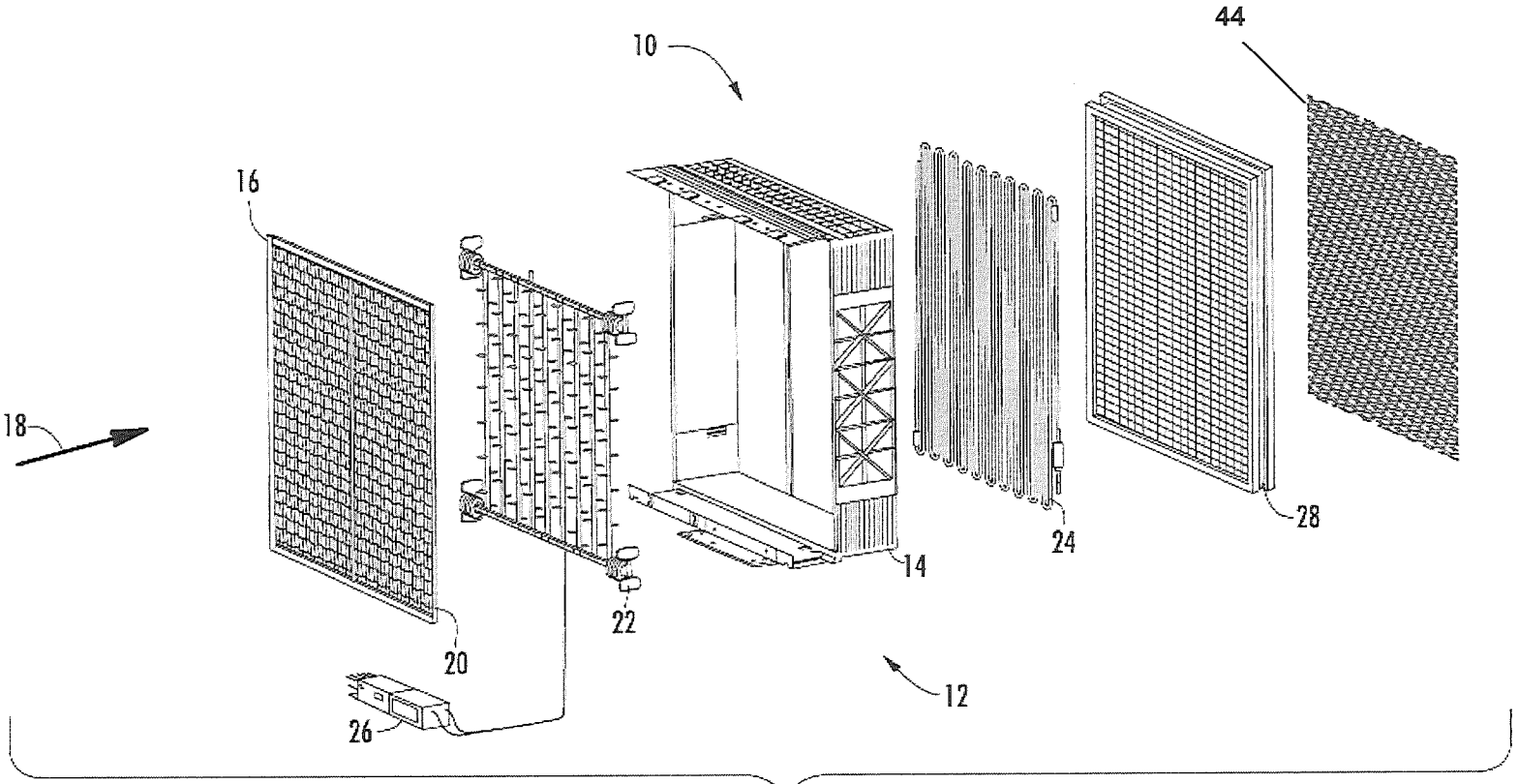
FIG. 1 schematically illustrates an embodiment of an air filtration system.

Shown in FIG. 1 is a view of an embodiment of an air filtration system 10. The air filtration system 10 of FIG. 1 is an electrically enhanced air filtration system 10, but it is to be appreciated that utilization of the present invention with other types of air filtration systems 10 having replaceable filters is contemplated within the present scope.

The air filtration system 10 includes a field enhancement module (FEM) 12, shown exploded in FIG. 1. The FEM 12 includes a frame 14. The frame 14 is configured to arrange the components of the FEM 12 which are secured therein. At an upstream end 16 of the FEM 12, relative to an airflow direction 18 of air through the filtration system 10, is an ionization array 22. The ionization array 22 is an array of points sufficiently sharp such as to produce corona discharge when a pre-determined voltage is applied. For example, the ionization array may comprise a plurality of thin wires, barbed wires, or any structure capable of producing the corona needed to yield ions. Some embodiments may further include a safety screen 20 upstream of the ionization array 22 which also acts as an upstream ground for the FEM 12. A field wire 24 is located downstream of the ionization array 22, and may be either insulated or non-insulated.

The ionization array 22 is connected to and energized by a high voltage power supply 26 resulting in a first voltage across the ionization array 22. A media filter 28 is disposed in the frame 14 downstream of the field wire 24. In some embodiments, the media filter 28 includes an electrically grounded plane 44 at a downstream end of the media filter 28, which may be, for example, formed of expanded metal or carbon paint.

Figure 2:
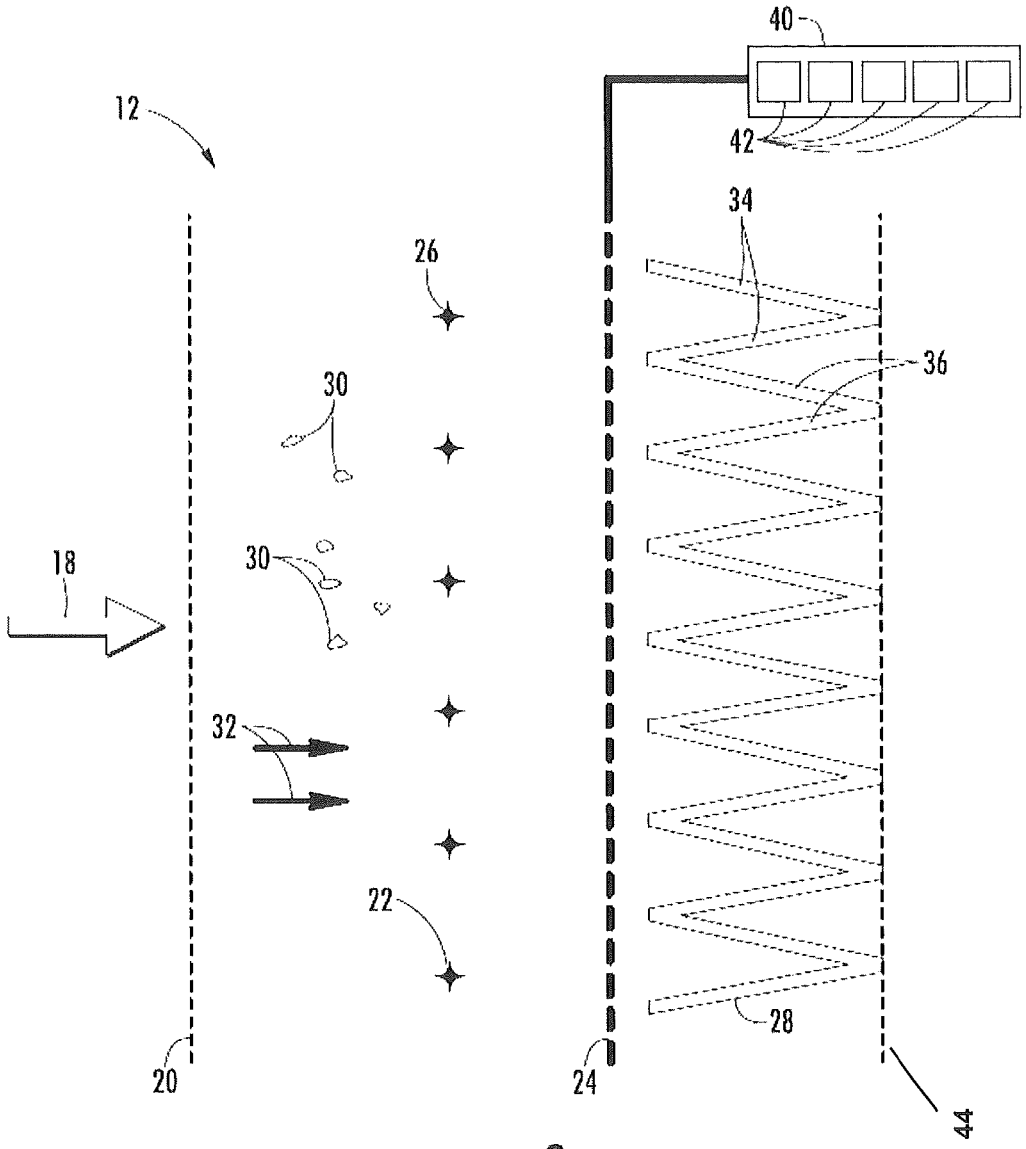
FIG. 2 is a schematic cross-sectional view of an embodiment of an air filtration system.

Referring now to FIG. 2, when the power supply 26 is activated, the ionization array 22 ionizes particles 30 in an airstream 32 passing through the FEM 12. A second voltage across the field wire 24 polarizes media fibers 34 of the media filter 28, which causes the ionized particles 30 to be attracted to and captured by the media fibers 34.

The field wire 24 is not directly connected to the power supply 26, but is passively energized via an ionic space charge, such as that generated by corona discharge from the energized ionization array 22. The corona discharge occurs when the airstream 32 is ionized when passing through the highly energized ionization array 22. For example, in some embodiments, the ionization array 22 is energized by the power supply 26 to about 20,000 volts, resulting in a highly ionized airstream 32 flowing past the field wire 24. The electrical energy of the airstream 32 energizes the field wire 24 to, in some embodiments, between about 5000 and 10,000 volts.

In some embodiments, the voltage produced in the field wire 24 by the current leakage from the ionization array 22 is higher than desired for operation of the system 10. In such cases, the voltage at the field wire 24 is regulated by a regulator module 40. The regulator module 40 is connected to the frame 14 for ground and includes a plurality of diodes 42 or other voltage regulation mechanisms. For example, in some embodiments, it is desired to regulate the voltage at the field wire 24 to about 1000 volts. In such embodiments, the voltage regulator module 40 may include five 200-volt diodes to regulate the voltage to the desired 1000 volts. It is to be appreciated that this is merely exemplary, and other desired voltages and regulator 40 configurations are within the present scope.

Energizing the field wire 24 via leakage current from the ionization array 22 rather than a separate connection to the power supply 26 allows for reduction of connection to the power supply 26 and also eliminates the need for the power supply 26 to provide the additional, different voltage to the field wire 24.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An air filtration system comprising:

a frame directing an airflow through the air filtration system;

a power supply;

an ionization array disposed in the frame across the airflow and connected to the power supply, the power supply providing a first voltage to the ionization array;

a field wire disposed in the frame downstream from the ionization array, the field wire energized to a second voltage only by an electrical energy discharge from the ionization array; and a regulator module operably connected to the field wire to regulate the second voltage.

2. The air filtration system of claim 1, wherein the regulator module comprises a plurality of diodes.

3. The air filtration system of claim 1, wherein the regulator module is configured to regulate the second voltage to about 1000 volts.

* * * * *